US008633426B2

(12) United States Patent
Macher et al.

(10) Patent No.: US 8,633,426 B2
(45) Date of Patent: Jan. 21, 2014

(54) ELECTRICALLY HEATABLE SHEET OF GLASS, METHOD FOR PRODUCTION THEREOF AND ALSO WINDOW

(76) Inventors: David Macher, Voitsberg (AT); Gerhard Kremer, Fuerstenfeld (AT); Urs Maron, Nidau (AT)

( * ) Notice: Subject to any disclaimer, the term of this patent is extended or adjusted under 35 U.S.C. 154(b) by 102 days.

(21) Appl. No.: 12/804,472

(22) Filed: Jul. 22, 2010

(65) Prior Publication Data

US 2012/0080421 A1 Apr. 5, 2012

(30) Foreign Application Priority Data

Jul. 24, 2009 (EP) ..... 9 009 630

(51) Int. Cl.
*H05B 3/06* (2006.01)

(52) U.S. Cl.
USPC ..... 219/522; 219/203; 219/547

(58) Field of Classification Search
USPC ..... 219/522, 547, 203
See application file for complete search history.

(56) References Cited

U.S. PATENT DOCUMENTS

| | | | | | |
|---|---|---|---|---|---|
| 4,385,226 | A | * | 5/1983 | Sauer | 219/522 |
| 4,450,201 | A | * | 5/1984 | Brill et al. | 428/336 |
| 4,786,784 | A | * | 11/1988 | Nikodem et al. | 219/543 |
| 4,952,783 | A | * | 8/1990 | Aufderheide et al. | 219/528 |
| 5,448,037 | A | * | 9/1995 | Takase et al. | 219/547 |
| 5,493,102 | A | * | 2/1996 | Takase et al. | 219/547 |
| 5,543,229 | A | * | 8/1996 | Ohsaki et al. | 428/432 |
| 5,750,267 | A | * | 5/1998 | Takase et al. | 428/469 |

* cited by examiner

*Primary Examiner* — Nitin Parekh
(74) *Attorney, Agent, or Firm* — Marshall & Melhorn, LLC

(57) ABSTRACT

The invention relates to an electrically heatable sheet of glass (10), including at least one electrically conductive coating applied on at least one side of the sheet of glass and also to at least one contacting applied at least in regions on the coating, the contacting being configured as a spray coating.

11 Claims, 4 Drawing Sheets

ELECTRICALLY HEATABLE SHEET OF GLASS, METHOD FOR PRODUCTION THEREOF AND ALSO WINDOW

BACKGROUND OF THE INVENTION

The present invention relates to an electrically heatable sheet of glass which has an electrically conductive coating on the surface of the sheet of glass and also to a special contacting of this electrically conductive coating. Furthermore, the present invention relates to a method for the production of this sheet of glass and also a window which includes the sheet of glass according to the invention. Likewise, possibilities for using the sheet of glass are indicated.

Electrically conductive and extensively transparent coated glasses and plastic material films have attained a wide field of application industrially. The functions of such substrates with electrically conductive transparent thin layers extend from the cover electrode in liquid crystal display elements, so-called liquid crystal displays (LCDs), via thin film transistor (TFT) displays, via cover electrodes for electroluminescent displays, computer screen elements as far as electrostatic screening elements, heating elements for mirrors and burglar alarm glazing and the like.

The production of such electrically conductive and extensively transparent inorganic thin films can thereby be effected in sputtering technology or vapour deposition technology and also pyrolytically with a subsequent temperature treatment in the range of 450 to 750° C. The thermoplastic films or sheets are coated for example by means of low temperature sputtering and deposition technologies. Likewise, indium-tin oxide (ITO) or tin oxide (NESA) pastes and similar metal oxides which are embedded in a corresponding polymer matrix or pastes with intrinsically conductive polymers, electroactive polymer films, such as polyanilines, polythiophenes, polyacetylenes, polypyrrols (Handbook of Conducting Polymers, 1986) and such polymers with and without metal oxide filling are used. These are applied by means of screen printing, knife-coating, spraying, painting and similar application techniques, substantial achievements in drying at low temperatures of for example 80 to 120° C. having been made and also in the high elasticity in the case of deformation and of course in the case of as high transparency as possible with low surface resistance.

A special type of electrically conductive and highly transparent float glass is represented by the pyrolytically produced layers which have high surface hardness and the electrical surface resistance of which can be adjusted within a very wide range of typically a few milliohms up to 3,000 ohms per square with a daylight transparency of typically 77 to 86%. There may be mentioned here by way of example TEC glass by the company Pilkington Libbey-Owens-Ford, Toledo Ohio, USA. Glass with the name TEC 15/4 has 4 mm glass thickness and offers a surface resistance of less than 14 ohms per square with a daylight transparency of 83%. Glass with the name TEC 70/4 likewise has 4 mm glass thickness and offers a surface resistance of less than 80 ohms per square with a daylight transparency of 82%. Such glasses can be readily shaped and have good scratch resistance. In particular, scratches do not lead to an electrical interruption of the electrically conducting surface layer but merely to a generally slight increase in surface resistance. In the case of purely surface layers, such as an ITO sputtered layer or vapour deposited layer, damage to the surface, such as for example scratches or cracks due to thermal surface tensions, lead to an interruption in the electrical surface conductivity and hence to failure of the system. Furthermore, pyrolytically produced conductive surface layers are diffused and anchored strongly in the surface by their temperature treatment such that, with a subsequent material application, an extremely high adhesive bond to the glass substrate is provided, which is likewise very advantageous for the present invention. In addition, such coatings have good homogeneity, i.e. a low dispersion of the surface resistance value over large surfaces and this property likewise represents an advantage for the present development.

The use of such K glasses as electrical heating element for example mirror heating and the like is likewise already known.

In WO 01/10790, a glass article for use in building technology for reducing heating due to solar radiation is described. In this invention, a coating of a glass substrate based on antimony-doped tin oxide layers in combination with fluorine-doped tin oxide layers is mentioned such that high light permeability of visible light is achieved therefrom and, at the same time, low permeability by sunlight is provided.

In WO 00/53062, a window element for a display case is described, which is formed from a tempered glass plate which has a transparent and electrically conductive coating and a pair of electrically conductive bus bars on at least one side, the conductive coating being able to be heated. In a further embodiment, a spaced two-sheet window element is described; the inside of the outer sheet of glass or the outside of the inner sheet of glass is thereby heated. Furthermore, it is explained that the electrically conductive coating is formed from the group consisting of tin oxide, indium-tin oxide, zinc oxide and cadmium stannate, it has a thickness of 50 to 900 nanometers and each individual bus bar of the pair of bus bars comprises electrically conductive material which is chosen from the group silver, silver alloy, copper and copper alloy. Application of the pair-wise bus bar contact strips is effected before application of the electrically conductive transparent layer. After application of the pair-wise bus bar contact strips and subsequent to the electrically conductive coating, the sheets of glass are bent to the desired contour and tempered in the glass melting furnace. The lateral spacing and sealing elements are described in detail in a further patent specification U.S. Pat. No. 5,622,414.

In EP 0 300 300 B1, a method for applying a coloured coating on a surface of a sheet of glass by means of a screen printing technique and using pasty to free-flowing mixed coating mixtures from layer silicates, oxides, metal modifications and carbon modifications with a binder solution based on phosphate and hence to a glass frit-free coating mixture is described and, applied in such a manner on the glass surface, is burnt in at temperatures in the range of between 550 to 700° C. In a special embodiment, the coating mixture is adjusted to be conductive by adding carbon black by up to 10 parts by weight and sheets of glass treated in this way offer good resistance to breakage, good adhesion- and scratch resistance, and also good corrosion resistance and good suitability for composite glass safety sheets.

In WO 93/26138 and WO 94/00044, a radiant heating panel and electrically heatable tableware and corresponding production methods were described. Underlying both inventions is a so-called electric-arc spraying process in the form of flame spraying or plasma spraying.

In U.S. Pat. No. 5,080,146, an improved and cost-saving method for filling units of composite sheets of glass with a low-conductive gas, such as the relatively expensive krypton or also with argon, xenon, $CO_2$, air, $SF_6$ and fluorocarbon gas, is described. In this invention, the seal at the glass edges is furthermore described and seals based on silicones, butyl rubber, polyurethanes or polysulphides are mentioned and a gas loss of composite sheets of glass sealed in this manner of less than 1% over very long periods of time is indicated.

In EP 0 394 089 B1, an electrically heatable car sheet of glass with an electrically conductive, transparent surface coating serving as heat resistance, with current supply conductors disposed along two oppositely situated sheet edges and with a frame-like decorative layer made of an opaque and electrically conductive colour, in particular a burnt-in colour, is described. The two current supply conductors are in electrically conducting contact with the surface coating and consist of metal foil strips or metal bands which are in electrical contact with the decorative layer in the region of the frame-shaped decorative layer. In this invention, absolutely no electric-arc spraying processes for production of contact strips are mentioned either.

In EP 0 397 292 B1, a method for the production of a thin transparent and electrically conducting layer made of metal oxide(s) on a substrate, in particular on glass, is mentioned. This is achieved by spraying on metal compounds made of indium formiate and for example dibutyltin oxide and/or dibutyltin difluoride as a powder in suspension in a carrier gas onto the substrate brought to an increased temperature, which metal compounds decompose in contact with the substrate and, with formation of the metallic oxide layer, oxidise or the powder in contact with the substrate being pyrolised with formation of a thin layer based on indium oxide.

BRIEF SUMMARY OF THE INVENTION

Starting herefrom, it was the object of the present invention to provide an electrically heatable sheet of glass which has improved contact to the electrically conductive coating, the contacting being able to be produced in a simple and readily reproducible manner.

This object is achieved with respect to the sheet of glass with the features described herein, and with respect to the window which includes the sheet of glass. A production method for the production of the sheet of glass is also described, along with alternative usage possibilities for the sheet of glass and also the window according to the invention.

According to the invention, an electrically heatable sheet of glass is hence provided, which has at least one electrically conductive coating applied on at least one side of the sheet of glass and also at least one contacting applied at least in regions on the coating, the contacting being configured as a spray coating.

The invention hence relates to a sheet of glass, in particular for use as a window, glass doors, a glass partition or glass heating panels in buildings, automobiles, mobile and stationary appliances and similar applications. Normally, in modern window constructions, two or more similar or dissimilar spaced sheets of glass made of flat glass, also termed float glass, of a thickness of a few mm to approx. 21 mm, typically of 4 mm thickness and 16 mm spacing, are used. The embodiments can be configured corresponding to the properties for heat protection, sun protection, sound protection, fire protection, person and object protection and the like or also for combinations of the mentioned types.

A normal flat glass dimension is for example 6.00×3.21 meters. The sheets are produced therefrom for typical multi-sheet insulating glass constructions, hermetically sealed intermediate spaces being produced by the edge bond and filled normally with a noble gas, the gas pressure being set corresponding to the barometric air pressure at the location and at the time of production. At the time of the production, there is therefore an equilibrium between the pressure in the glazing unit and the exterior barometric pressure in the production environment.

In addition to these double, triple or even multiple insulating glass constructions made of simple float glass, such multisheet insulating glass constructions can also be formed from sheets which have a coating on one or both sides and, in this way, influence the reflection and/or transmission in the desired wavelength ranges of the light, furthermore the individual sheets can be pre-tensioned or be configured coloured throughout or else be formed from safety glass.

Safety glass or safety insulating glass concern glasses developed originally for the automobile industry for vehicle glazing and such safety glass elements constructed in the manner of a sandwich are used nowadays more and more in building technology. Basically, a distinction is thereby made between single-sheet safety glass and composite safety glass. In principle, both types can be used in the present invention. A typical safety glass construction thereby consists of two float glass sheets with a thin inner layer made of polyvinylbutyral (PVB), polyurethanes (PU), polyvinylchlorides (PVC) or similar polymers with corresponding light refractive indices of greater than 1 and less than 2, typically in the range of 1.5.

Furthermore, the so-called k-value is of importance for the present invention. The heat transfer number k indicates how much energy is lost, indicated in watts per square meter of glass surface and degree of temperature difference in Kelvin ($W/m^2K$). A small k-value means a smaller energy loss. Normal k-values of single-sheet glasses of a few mm thickness are 5 to 6 $W/m^2K$, whilst modern insulating glass constructions made of for example 4 mm float glass and 16 mm argon gas and 4 mm float glass, according to the type of coating, achieve k-values in the range of 1.7 to 1.1 $W/m^2K$.

In a preferred embodiment, the contacting is formed from materials which are selected from the group consisting of metals or alloys hereof with a conductivity a of more than $1 \cdot 10^6$ S/m, in particular metals or alloys selected from the group consisting of tin, zinc, silver, palladium, aluminium, tungsten, rhenium, tungsten-rhenium, molybdenum, molybdenum-rhenium, rhodium.

The contacting is thereby expediently applied at least two places of the electrically conductive coating (these places can be disposed for example on oppositely situated sides on one surface of the sheet), the contacting itself being formed from at least one layer. However, the possibility is also offered of the contacting comprises at least two layers, the materials of the at least two layers being able to be the same or different.

The total thickness of the contacting is thereby preferably from 0.001 to 5.0 mm, preferably from 0.01 to 1.0 mm, particularly preferred from 0.05 to 0.3 mm.

The contacting can thereby be applied for example in the form of contact strips or as bus bars.

The contacting is thereby applied by means of a galvanoplastic process, for example plasma spraying or flame spraying, the contacting not being configured as a uniform, continuous metal layer, rather it has a grainy structuring or has a porous configuration. The contacting hence has a certain surface roughness.

There are possible as materials for the electrically conductive coating, in particular materials which are selected from the group consisting of indium-tin oxide, tin oxide doped with antimony and/or fluorine, zinc oxide, cadmium stannate and/or combinations hereof. The coating can thereby be produced in particular according to the method described in EP 0 397

292. A thin electrically conductive and extensively transparent layer produced in this way is very well suited to the present invention.

In order to impair the optical transparency of the produced sheet of glass as little as possible, the layer thickness of the electrically conductive coating is chosen such that the transmission of the coating is preferably in the wavelength range of 250 nm<λ<850 nm, measured at a layer thickness of 0.3 to 0.5 μm, preferably 0.4 μm, between 60 and 99%, preferably between 75 and 90%.

The sheet of glass on which the coating and the contacting is applied is thereby not restricted to special types of glass, rather all types of glass can be used. For example, float glass, single-sheet safety glass or composite sheets of glass are hereby possible. The composite sheets of glass comprise thereby cast resins or tough elastic thermoplastic plastic material films, in particular a polyvinylbutyrate, polyurethane or polyvinylchloride film, in order to produce the composite.

According to the invention, a window is likewise provided, which includes at least one of the sheets of glass according to the invention which were described previously.

In an advantageous embodiment, at least one further sheet of glass is disposed at a spacing relative to the sheet of glass, preferably at a spacing of 3 to 20 mm, further preferred 8 to 10 mm.

A further subject of the invention is hence a window in the form of a multilayer two-dimensional construction comprising at least two spaced sheets of glass which are edged circumferentially in an air-tight manner and at least one sheet of glass has an extensively transparent and electrically conductive coating on the inside, which is provided with readily electrically conductive contacting strips on two oppositely situated sides and these contacting strips are supplied with direct or alternating current and hence the extensively transparent and electrically conductive coating on the inside is heated and, in this way, the transparent heating element radiates heat predominantly only on one side. The at least two spaced contacting strips are applied by means of the electric-arc spraying process directly onto the electrically conductive and extensively transparent coating. The intermediate space formed by the two sheets is preferably filled with a noble gas, preferably argon, xenon or krypton.

Furthermore, the further sheet of glass can have a heat-reflecting coating at least on the side orientated towards the first sheet of glass. The coating is thereby selected as a function of the wavelength range to be reflected and consists of metals and/or alloys known to the person skilled in the art.

According to the invention, a method for the electrical contacting of a sheet of glass provided with at least one heating layer is likewise provided, in which the application of the electrical contacting is effected by means of a galvanoplastic process, selected from the group consisting of plasma spraying, flame spraying, high speed flame spraying, detonation spraying, cold gas spraying, electric-arc spraying, plasma-powder application welding and/or laser spraying, at least in regions onto the heating layer.

The present invention is explained in more detail with reference to the subsequent embodiments without restricting the invention to the special parameters represented there.

Transparent heating elements based on an electrically conductive and extensively transparent coated surface require as good as possible electrically conductive contacting strips or so-called bus bars at least on two oppositely situated sides. As long as only small electrical powers require to be introduced on electrically conductive surfaces, spring contacts or carbon-filled rubber elements or so-called zebra rubber strips suffice. Often, conductive adhesive pastes based on silver or palladium or copper or gold-filled polymer adhesives are used. In the case of heating elements which are intended to function over very long periods of time with very high temperature differences and high electrical currents, such conductive adhesives have not proved to be successful and the electric-arc spraying process offers very substantial functional and constructive and economical advantages. The layer thickness can likewise be freely chosen in a wide range of typically 0.05 to 0.30 mm, just as the geometric arrangement thereof and the composition of the metallic elements. For example, flame- or plasma-sprayed contacting strips made of tin and zinc or aluminium offer outstanding soldering capacity and, in this way, the electrical terminals can be produced very simply by soldering, friction welding or even by crimping or terminal elements applied frictionally can be produced simply with for example a microrough surface. In addition, contacting strips produced in this way can make possible a homogeneous electrical field in the case of contact strips which are not disposed in parallel, by means of suitable material choice and the choice of the geometric arrangement and also optionally of the layer thickness. This is very important for example in the case of glass elements or contact strips which extend conically or in a curve since, in this case, no homogeneous voltage gradient would be formed with a homogeneous resistance on the sheet of glass and therefore the contacting strips would have to form a conductivity- or resistance profile because of their design so that, in the electrically conductive glass coating, a homogeneous or a desired electrical field profile is formed and, in this way, leads to a homogeneous or desired two-dimensional heating.

In the coating process for the contacting, two metallic wires are supplied one on the other. These wires are provided as electrical conductors, with different poles (positive and negative) in order to ignite an electric arc. The for example 4,500° C. hot microparticles are accelerated via compressed air and are applied with high energy on the surface, e.g. glass.

The heating layer is applied in the production process of the glass, good adhesion between glass and heating layer is therefore produced.

The aluminium layer is applied subsequently by sputtering. Due to the high energy density and speed, a good bond to the glass and the heating layer is likewise produced, the aluminium layer serving as bonding agent for the conducting zinc layer.

The zinc layer is likewise applied via sputtering. It serves as solderable layer for an electrical connection to the energy supply.

Technical Data

Zinc Coating

The material can also be soldered.

Composition

| | |
|---|---|
| Zinc | 99.99 (minimum) |
| Copper | 0.002 (maximum) |
| Physical coating properties | |
| Melting point | 420° C. (approx.) |
| Bond strength | 8.4 MPa, irradiated steel surface<br>2.4-6.4 MPa, irradiated plastic material surface |
| Coating expandability | 89.6 MPa |
| Hardness | 13 Rh/146 Knoop 100 |

-continued

| | |
|---|---|
| Coating density | 6.36 g/cm$^3$ (91%) |
| Shrinkage | 0.001 cm/cm |
| Coefficient of expansion | 0.000564 mm/2.45 cm × 0.38° C. (22.2 micro-in/in × ° F.) |

Spraying Process with 8830

| | |
|---|---|
| Sputtering air pressure in bar | 3.1-4.8 |
| Current strength in amps | 150-350 |
| Spacing in cm relative to the glass | 13-30 |
| Coating structure in mm aa | 0.00635 |

Technical Data

Aluminium Coating

Produced exclusively for high energy coatings. Properties are its resistance capacity to atmospheric and chemical and also to thermal corrosion. The material has in addition good electrical and heat conductivity.

Composition

| Physical application properties | |
|---|---|
| Melting point | 660° C. (approx.) |
| Coating elongation resistance | 34.4 MPa |
| Coating density | 2.51 g/cm$^3$ |
| Oxide content | less than 2% |
| Porosity | 2.1% |

Spraying Process when Using 8330

| | |
|---|---|
| Sputtering air pressure | 45-70 |
| Current strength in amps | 200-350 |
| Spraying distance in cm | 17 |
| Layer thickness/application in μm | 125 |
| Layer structure (mm aa) | Fine |
| (microinches aa) | 0.000381-0.00762 |

BRIEF DESCRIPTION OF THE DRAWINGS

A few embodiments of the invention are described subsequently in detail with reference to the drawing Figures.

There are thereby shown.

DETAILED DESCRIPTION OF THE INVENTION

Figure 1:
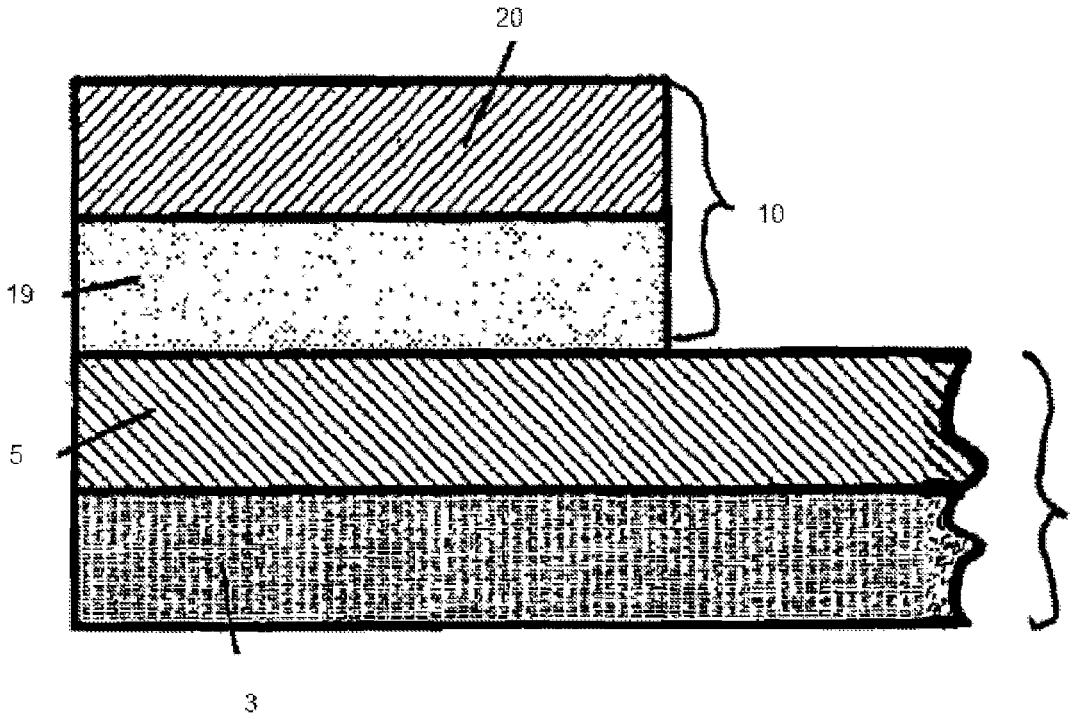
FIG. 1: a schematic representation of the construction of a sheet of glass according to the invention.

In FIG. 1, a sectional picture of a sheet of glass 18 according to the invention is represented. The support structure and base forms a sheet of float glass 3 on which an electrically conductive coating 5 (e.g. made of ITO) is applied. This coating 5 can be applied by methods known from prior art, e.g. by means of sputtering processes. At the edge of this coated sheet of glass 18, the contacting 10 is applied, which is formed in this case from two separate layers made of aluminium 19 and zinc 20. Both the aluminium coating 19 and the zinc coating 20 are thereby applied via galvanoplastic processes (e.g. by means of plasma- or electric-arc spraying.

Figure 2:
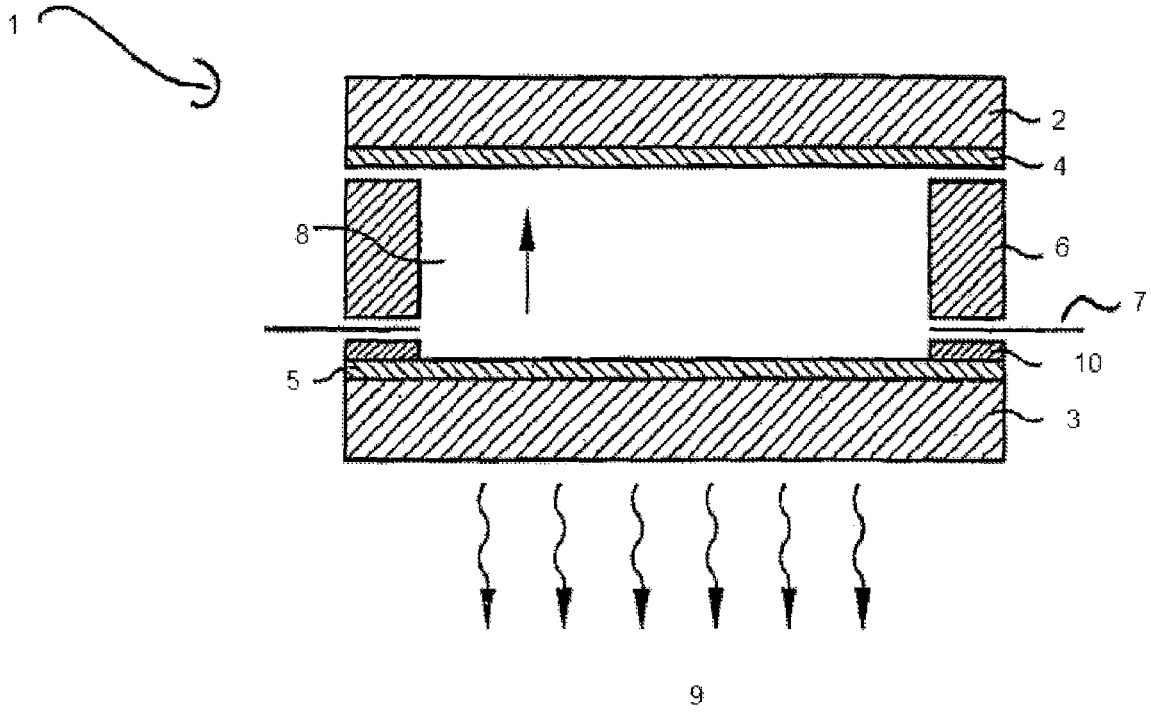
FIG. 2: a schematic representation of an arrangement according to the invention in sectional side view, two spaced sheets of float glass being shown in this simple basic embodiment.

In FIG. 2, a simple basic embodiment of a transparent heating element 1 based on a float glass 2 on the outside and a float glass 3 at a spacing is represented. The two float glasses are spaced by spacers 6 and effect at the same time the seal for the noble gas 8. In a preferred embodiment, a high-molecular noble gas, for example krypton, is used. The filling and sealing is thereby effected according to the state of the art. According to the invention, a float glass 3 is now provided on the inside with an electrically conductive and extensively transparent coating 5 (see FIG. 1) disposed on the inside. At desired places which are situated in general at least two spaced places of the coated float glass 3, 5, so-called contacting strips 10 are applied by means of the electric-arc spraying process, in particular by means of the flame spraying process and the plasma spraying process.

Subsequently, contacting elements 7 are applied on these at least two contacting strips 10. The application can be produced by means of soldering, friction welding, ultrasonic welding or even merely by means of frictional contact elements 7, the two-dimensional surface of the contact elements 10, in a special embodiment, being provided with a rough and electrically readily conductive surface and this rough contact surface, during pressing onto the contact strips 10 in small arbitrarily distributed regions, deforming the surface permanently and possibly also piercing a delicate surface oxide layer and in this way producing a good and low-ohmic contact between the contacting elements 7 and the contacting strips 10.

Preferably the sheet of float glass 2 is used on the outside with a coating 4 disposed on the inside. This coating 4 thereby has the function of heat reflection of the heated surface of the electrically conductive coating 5, on the one hand, and can also serve furthermore for a reduction in the heat radiation due to solar radiation and, in this case, must be configured such that any light penetrating from outside from the externally situated side of the sheet of float glass 2 is correspondingly reflected.

Furthermore, the sheet of float glass 2 on the outside can already have an intrinsic colour, i.e. consist of a float glass coloured throughout the material, as a result of which the solar radiation is increasingly absorbed and dissipated externally by convection.

The solar protection effect is thereby dependent upon the colour and the thickness of the float glass which is used.

Heat insulation can thereby be achieved only in conjunction with a corresponding coating 4 and a noble gas filling 8 or also with the coating 5.

By applying an electrical voltage to the contacting elements 7, heating of the coating 5 is effected, according to the impressed electrical power, and the heat radiation 9 is effected predominantly furthermore towards only one side of the transparent heating element and an economical and two-dimensional and extensively transparent heating element 1 can be produced in this manner.

By way of example, a heating body with 100 watts per square meter at approx. 37 volts and approx. 2.7 amps can be achieved in this way on the basis of a coating 5 with 14 ohms per square. In the case of a coating 5 with 80 ohms per 10 square and 50 watts per square meter, typically 63 volts and 0.80 amps are required.

According to the invention, a transparent heating element 1 of this type therefore does not concern a primary heating element but transparent heating elements 1 of this type are intended to assist room heating and wellbeing and hence two-dimensional heating elements which are architectonically very interesting and promote human wellbeing can be used.

Figure 3:
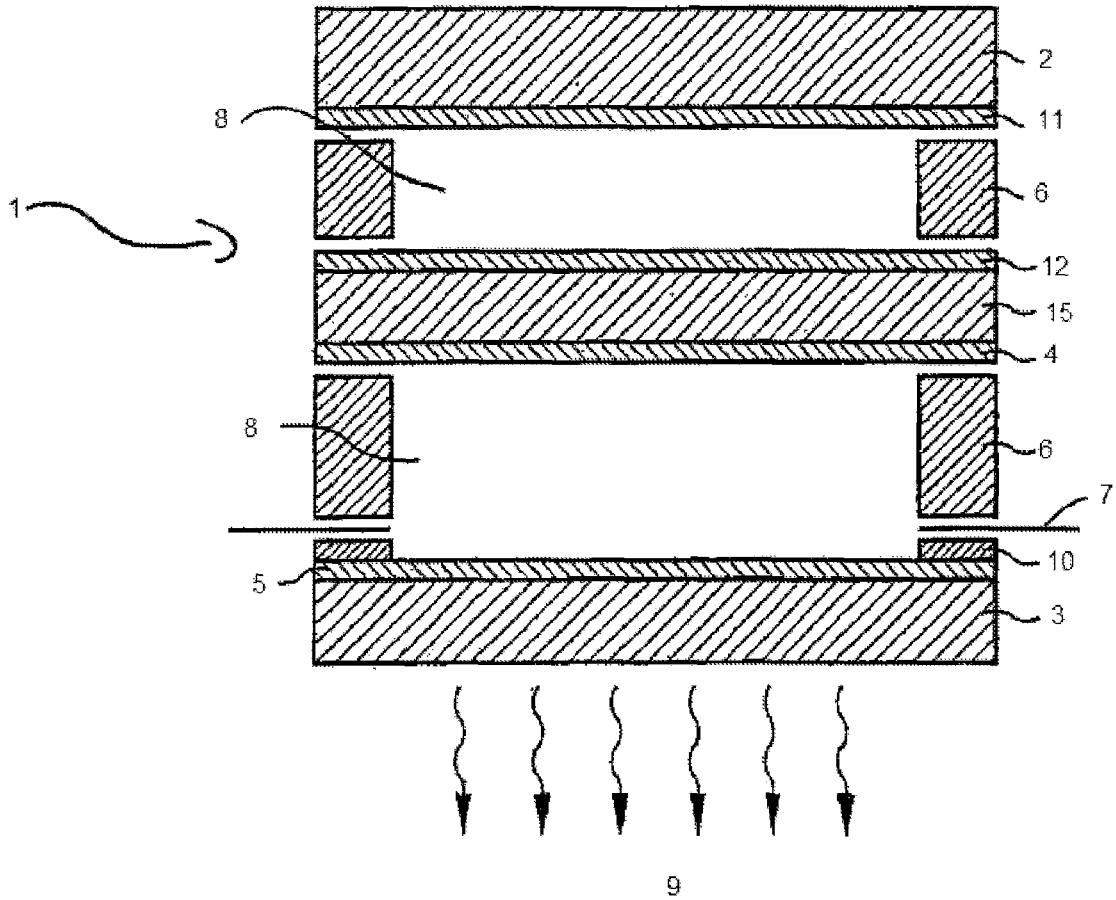
FIG. 3: a further schematic representation of an arrangement according to the invention in sectional side view, 3 spaced sheets of float glass being used in this embodiment.

In FIG. 3, a further schematic representation of an arrangement according to the invention is represented in sectional side view in the form of 3 spaced sheets of float glass 3, 15, 2. Such an embodiment now has two cavities 8 which are filled with noble gas and has in addition a float glass 15 in the centre. This float glass 15 can now be provided on both sides with a thin coating 12, 4. Preferably, the coating 4 is thereby configured as a reflector for heat radiation. The coating 12 can be configured for reduction in solar radiation heat. The coating 11 of the sheet of float glass 2 on the outside is preferably likewise configured for reduction in heat radiation by the sun, however it can likewise assume optical functions and also heat protection functions.

This triple arrangement is of advantage in particular in the case of high temperature differences between inside and outside since, as is known, high temperature differences lead to high stresses in the edge or enclosure, represented graphically by the spacers 6, which also effect the seal of the noble gas chambers 8. It is obvious that, due to a 2-chamber system of this type based on 2 noble gas chambers 8, in comparison with the arrangement in FIG. 2 with the same temperature differences between outside and inside, a temperature gradient which is approximately half as large is produced and, accordingly with extreme temperature differences, less stress upon all constructional elements is produced.

Figure 4:
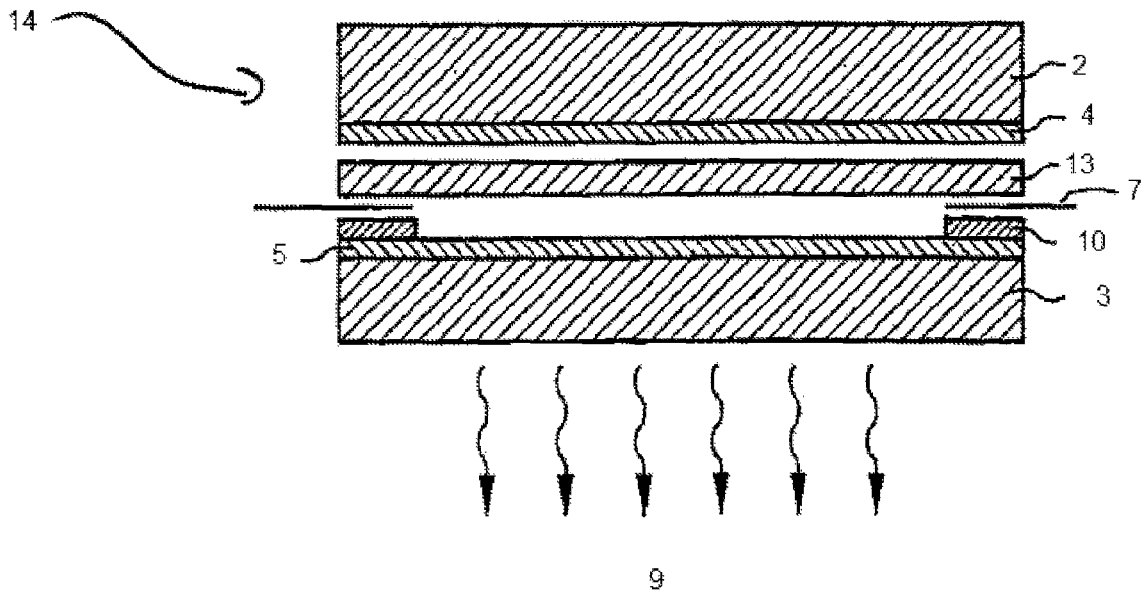
FIG. 4: a further schematic representation of an arrangement according to the invention in sectional side view, a composite sheet of glass being represented in this view.

In FIG. 4, a schematic representation of an arrangement according to the invention in sectional side view of a composite sheet of glass 14 is represented. Such a composite sheet of glass consists of at least two sheets of float glass 2, 3 and an inner layer 13 disposed in the centre.

Such inner layers 13 are preferably produced from polyvinylbutyral (PVB) or polyurethane (PU) or polyvinylchloride (PVC) and similar permanently elastic thin polymeric materials with good and high transparency and a typical refractive index of 1.5.

Such composite sheets of glass 13 are often termed safety glass or safety insulating glass or are configured specially for this purpose and are frequently used in automobile construction and also in the case of special glazing elements, such as for example a glass door, in building technology and safety technology.

Preferably, a thin coating 4 is applied on the inside of the sheet of float glass 2 and, on the sheet of float glass 3, an electrically conductive and extensively transparent coating 5 on the inside. The coating 4 is intended to have heat radiation insulating properties and can in addition have a further thin and transparent coating analogous to the coating 12, as described in FIG. 3, on the upper side of the sheet of float glass 2.

On the coating 5, at desired places which are situated in general at least two spaced places of the coated float glass 3, 5, so-called contacting strips 10 are now applied by means of the electric-arc spraying process, in particular by means of the flame spraying process and plasma spraying process. For this purpose, reference is made to the embodiments relating to the description of the FIGS. 1 and 2. Due to the small thickness of the inner layer 13, the contacting strips 10 must be chosen to be very thin and the contacting elements 7 must likewise have a very thin design. In addition, the contacting strips 10 and the contacting elements 7 must be configured before the lamination or assembly of the composite sheet of glass 14.

It is obvious that a composite sheet of glass 14 configured in this manner can be used also instead of the sheet of float glass 3 in FIG. 2 and in FIG. 3. Likewise, a composite sheet of glass 14 can be used without contacting strips 10 and without contacting elements 7 instead of the sheet of float glass 2 in FIG. 2 and instead of the sheet of float glass 2 or 15 in FIG. 3.

In addition, also transparent heating elements 1 with more than 3 sheets of float glass 1, 15, 3 can be configured; a combination with composite sheets of glass 14 is likewise possible.

The invention claimed is:

1. An electrically heatable sheet of glass, including at least one electrically conductive coating applied on at least one side of the sheet of glass and also at least one contacting applied at least in regions on the electrically conductive coating, wherein:

the contacting is configured as a porous spray coating;

the electrically conductive coating is selected from the group consisting of indium-tin oxide, tin oxide doped with antimony and/or fluorine, zinc oxide, cadmium stannate and/or combinations hereof; and the transmission of the electrically conductive coating in the wavelength range of 250 nm<λ<850 nm, measured at a layer thickness of 0.4 μm, is between 60 and 99.

2. The sheet of glass according to claim 1, wherein the materials of the contacting are selected from the group consisting of metals or alloys thereof with a conductivity a of more than $1*10^6$ S/m.

3. The sheet of glass according to claim 1, wherein the contacting includes at least one layer.

4. The sheet of glass according to claim 1, wherein the contacting includes at least two layers, the materials of the at least two layers being the same or different.

5. The sheet of glass according to claim 1, wherein the contacting has a total thickness of 0.001 to 5.0 mm.

6. The sheet of glass according to claim 1, wherein the contacting is applied in the form of oppositely situated contact strips or as bus bars.

7. The sheet of glass according to claim 1, wherein the sheet of glass is one of a sheet of float glass, single-sheet safety glass or a composite sheet of glass, the composite sheet of glass preferably having a cast resin and/or a tough elastic thermoplastic plastic material film, the film comprising one of a polyvinylbutyrate, polyurethane or polyvinylchloride film.

8. A window comprising a sheet of glass according to claim 1.

9. The window according to claim 8, wherein at least one further sheet of glass is disposed at a spacing of 3 to 20 mm, the space enclosed by the two sheets of glass being edged circumferentially in an air-tight manner at the edges of the sheets of glass.

10. The window according to claim 9, wherein the intermediate space formed by the spacing is filled with a noble gas, the noble gas comprising one of argon, xenon or krypton.

11. The window according to claim 9, wherein the at least one further sheet of glass has a heat reflecting coating at least on the side orientated towards the sheet of glass.

* * * * *